US005815868A

United States Patent [19]

Lee

[11] Patent Number: 5,815,868

[45] Date of Patent: Oct. 6, 1998

[54] MANUFACTURING PROCESS OF LONGITUDINALLY AND TRANSVERSELY ELASTIC AND EXTENSIVE FABRIC

[76] Inventor: Irene Lee, 9th Floor, No. 192, Sec. 1, Tun Hwa S. Road, Taipei, Taiwan

[21] Appl. No.: 826,189

[22] Filed: Mar. 27, 1997

[51] Int. Cl.[6] ..... D06B 1/04

[52] U.S. Cl. ..... 8/151.2; 68/13 R; 68/200

[58] Field of Search ..... 8/151, 150, 151.2, 8/149.1; 68/205 R, 13 R, 200; 28/100, 299

[56] References Cited

U.S. PATENT DOCUMENTS

| | | | |
|---|---|---|---|
| 3,549,597 | 12/1970 | Kitson et al. | 8/151.2 |
| 3,918,111 | 11/1975 | Dunn | 8/149.1 |
| 4,387,476 | 6/1983 | Bueb et al. | 68/205 R |
| 5,330,338 | 7/1994 | Nakata et al. | 8/151.2 |
| 5,499,911 | 3/1996 | Nakata et al. | 8/151.2 |

FOREIGN PATENT DOCUMENTS

| | | | |
|---|---|---|---|
| 7014830 | 4/1971 | Netherlands | 8/151.2 |

OTHER PUBLICATIONS

European Patent Office 47,911 8/151.2, Mar. 1983.

*Primary Examiner*—Frankie L. Stinson

*Attorney, Agent, or Firm*—Pro-Techtor International Services

[57] ABSTRACT

A manufacturing process of an elastic & extensile fabric provided with fine elasticity and extensibility longitudinally and transversely, especially of a duplex brushed fabrics knitted with polyester, the breakthtough of the present invention is that by increasing spandex (also called o.p.) during knitting of the fabric and by the brandnew manufacturing process thereof, the fabric can be extended to about 1.8 to 2 times of its original lengths longitudinally and transversely, and it can be durable for water cleansing in high temperature and has the effect of keeping warm, thus is applicable in gloves, mufflers etc. with a nature of being volume reducible.

1 Claim, 3 Drawing Sheets

| CONVENTIONAL DUPLEX FABRIC | DUPLEX FABRIC OF THE PRESENT INVENTION |
|---|---|
| with transverse directional slight extensibility | with extensibility and elasticity both in transverse and longitudinal directions |
| inferior extensibility (under about 1.3 times) | fine extensibility (under about 1.3 times) |
| without spandex | with spandex |
| not shaped before dyeing | shaped before dyeing |
| adding hair raising oil simultaneously with dyeing | adding hair raising oil after dyeing |

FIG. 3

MANUFACTURING PROCESS OF LONGITUDINALLY AND TRANSVERSELY ELASTIC AND EXTENSIVE FABRIC

BACKGROUND OF THE INVENTION

1. Field of the Invention

The present invention is related to an elastic & extensile fabric provided with elasticity as well as extensibility longitudinally and transversely and its manufacturing process, it is characterized in that, not only spandex (also called o.p.) can be increased during knitting of the fabric, but also a brandnew process of manufacturing is provided herein to make the fabric with excellent elasticity as well as extensibility longitudinally and transversely.

2. Description of the Prior Art

Duplex brushed fabrics knitted with polyester have been popularly used in human's ordinary life, such as those used in gloves, stockings, hats, mufflers etc. The conventional process chart of manufacturing of a duplex brushed fabric is described below in reference to FIG. 1 of the drawings attached herewith:

a. taking polyester as the material of yarn, normally it being made face yarn 11 and bottom yarn 12;

b. knitting the face yarn 11 and bottom yarn 12 into embryonic cloth 13 by a towel forward covering set of a circular knitter;

c. starting dyeing process 14 to give the yarn which originally is white a desired color, temperature for dyeing being about 135–140 degrees centigrade, time for it being about 30 minutes, hair raising oil being added simultaneously;

d. when color being right after checking of the dyed sampled yarn, glacial acetic acid being added to do neutralization 15 on the alkaline dye, water being added to cleansing the fabric for eliminating harmful substance and impurities etc.;

e. proceeding dehydrating and drying by baking 16;

f. due to the hair raising oil added before, a brushing machine being thereby able of picking up the hairs 17 in the fabric easily and roughly, the tissue of the fabric thereby being smoother and softer;

g. the fabric brushed having hairs of uneven length, so that process of hair cutting 18 being executed to trim them to have suitable length;

h. the fabric being delivered to a tumbler dryer 19 for tumbler drying granules;

i. the fabric being delivered to a stenter machine 20 under the shaping temperature of about 165 degrees centigrade, and being shaped under the delivering speed of 25 to 30 yards/minute to prevent it from deformation;

j. completing the finished product 21 of the duplex brushed fabric.

THE PROBLEMS TO BE SOLVED

The duplex brushed fabrics made by the above process are provided mostly with single transverse directional slight extensibility (total length less than about 1.3 times of the transverse length) due to the structure of the knitting machine, when they are used practically in the products of clothes, gloves etc., they are made the sizes not less than the actual sizes of the articles to be worn on, otherwise, they can not be worn on for being too small. So that they have the defect of being unsuitable for carrying and storing.

Moreover, conventional spandex (also called o.p.) is popularly used on swimming suits and acrobatic dance suits, swimming suits and acrobatic dance suits therefore are made quite extensile, however, they are subjected to a defect, i.e.: they are undurable for water cleansing in high temperature, this is because the spandex used is not covered by other yarn material, yet no heating treatment has been executed during their process of production, the structural molecules in the spandex are certainly be damaged when are heated directly in a high temperature and get elastic fatigue, this is why the swimming suits and acrobatic dance suits become larger when they are cleansed in a high temperature, while they can not restore their original size afterwards.

It can be seen from the above analysis:

1. The conventional duplex brushed fabric (taking the products made of polyester as an example) has only slight extensibility in only the transverse direction, the extensibility is inferior comparatively.

2. The conventional swimming suits and acrobatic dance suits are undurable for water cleansing in high temperature although they have rather large extensibility, yet they don't have the function of keeping warm, their range of application is limited.

SUMMARY OF THE INVENTION

The object of the present invention is to provide a duplex brushed fabric which is provided with fine extensibility in longitudinal and transverse directions (total length is about 1.8 to 2 times of the original lengths) due to the structure of the knitting as well as elastic restoring capability, and it has the advantage of high temperature durability.

The technical messures of the present invention resides in innovation of process wherein spandex is increased in the yarn material in company with the process flow of production in operation, so as to achieve the above mentioned object.

The present invention will be apparent after reading the detailed description of the preferred embodiment thereof in reference to the accompanying drawings.

BRIEF DESCRIPTION OF THE DRAWINGS

In the drawings:

FIG. 3 is a table comparing the main characteristics and the processes of production of the conventional duplex brushed fabric and the duplex brushed fabric of the present invention.

DETAILED DESCRIPTION OF THE PREFERRED EMBODIMENT

Figure 1:
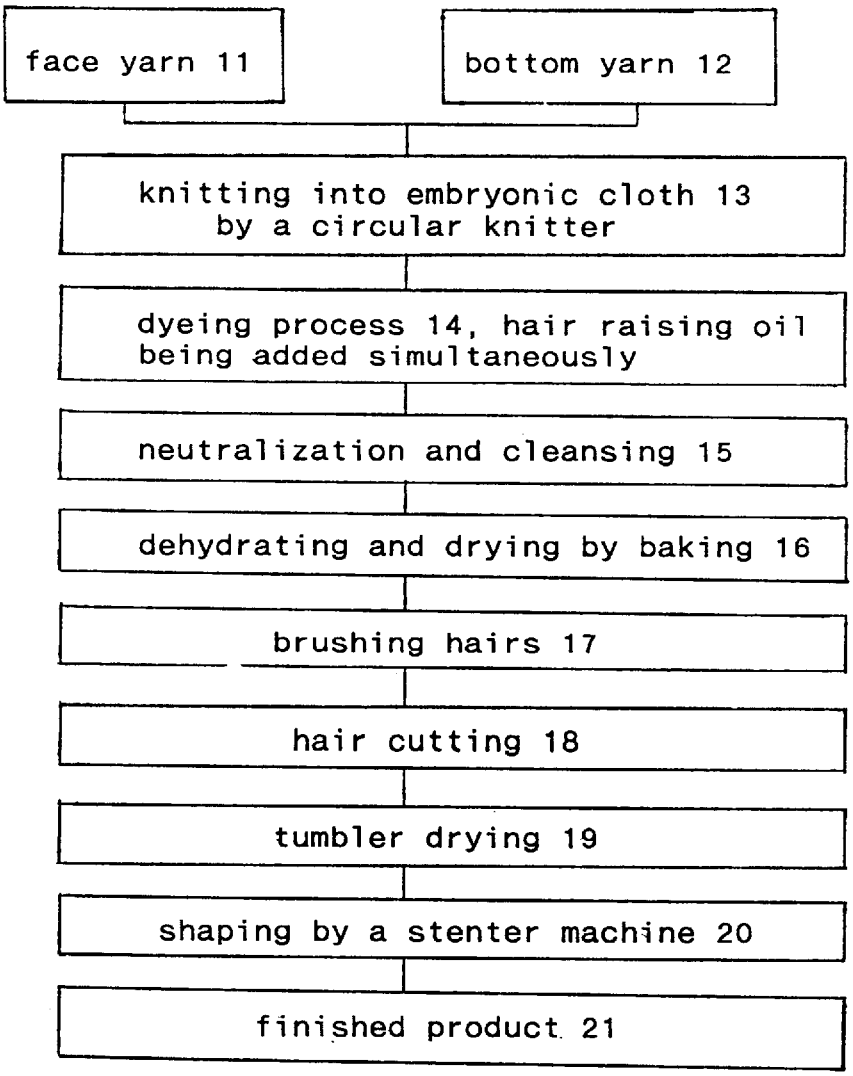
FIG. 1 is a flow chart of production of the conventional duplex brushed fabric.
Figure 2:
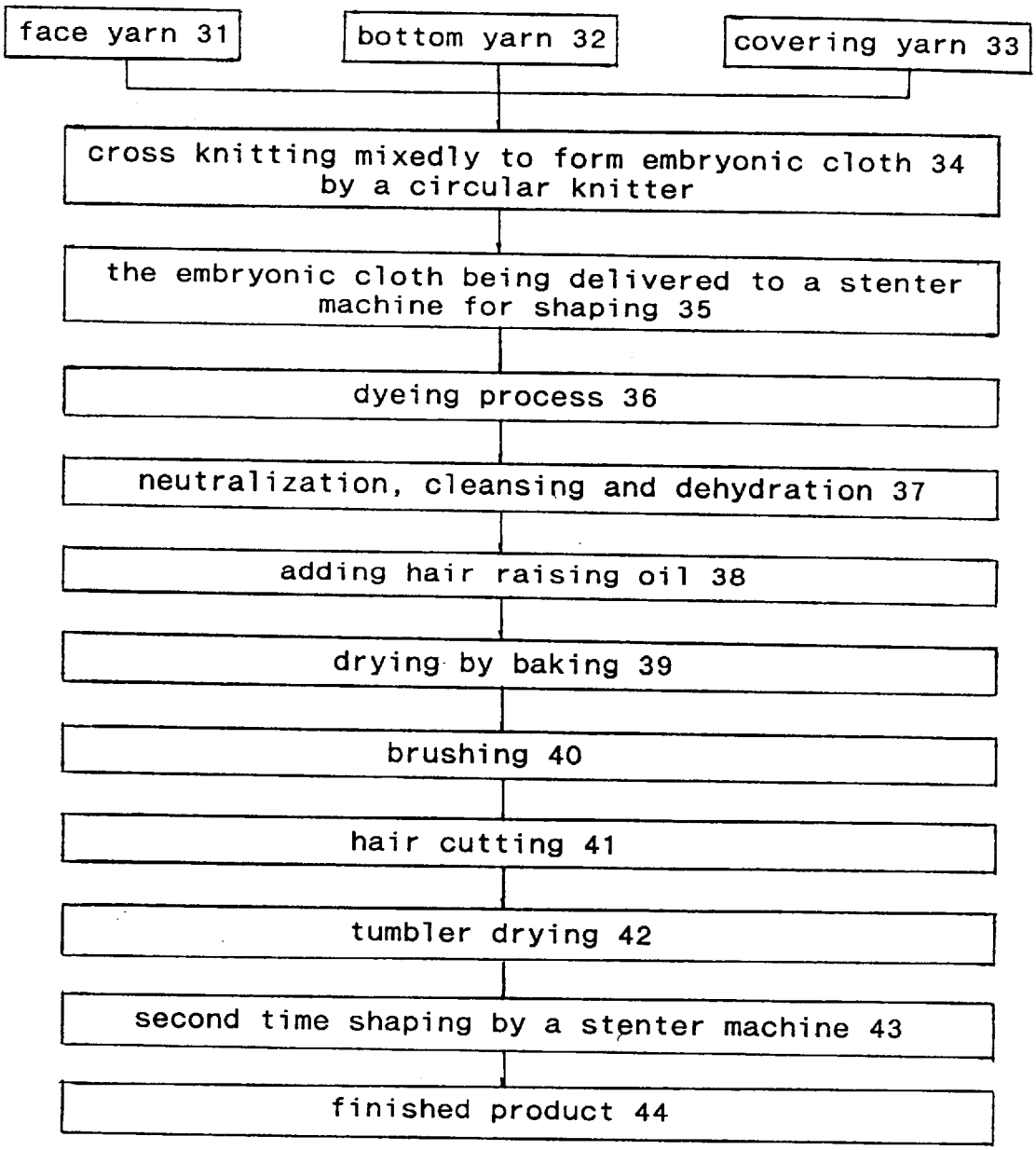
FIG. 2 is a flow chart of production of the duplex brushed fabric of the present invention.

Referring to FIG. 2, a preferred embodiment of the present invention is taken as an example for description:

a. In addition to taking polyester as the material of yarn for making face yarn 31 and bottom yarn 32, spandex is also added for making covering yarn 33, wherein, the face yarn 31 can be 75 D–150 D (Deniers/36 filaments/strand, depending on actual requirement), and occupy about 60% of the total yarn material; the bottom yarn 32 can also be 75 D–150 D, and occupies about 30% of the total yarn material; while the covering yarn 33 occupies about 10% of the total yarn material;

b. the face yarn 31, the bottom yarn 32 and the covering yarn 33 are cross knitted mixedly to form embryonic cloth 34 by a towel forward covering set of a circular knitter, wherein, the circular knitter can be of the type of 26–30 inches and 19–20 pins;

c. the embryonic cloth is delivered to a stenter machine for shaping 35 under the temperature of about 140 degrees centigrade, and is shaped under the delivering speed of 15 yards/minute to prevent it from changing width or weight due to adding of spandex therein when it is dyed under a high temperature;

d. proceed dyeing process 36 to give the yarn which originally is white a desired color, temperature for dyeing is about 125–130 degrees centigrade, time for it is about 25 minutes in favor of dyeing;

e. lower the temperature to 85 degrees centigrade, when color is right after checking of the dyed sampled yarn, glacial acetic acid is then added for neutralization, cleansing and dehydration 37;

f. hair raising oil only is added 38 now for avoiding breaking of the spandex during hair brushing which will in turn damage elasticity of the yarn;

g. after drying by baking 39, brushing 40 and hair cutting 41 are practised;

h. the fabric is delivered to a tumbler dryer 42, this is a duplex heating style tumbler dryer, wherein, temperature of dry hot air is in 120 degrees centigrade, besides, another gas is water vapour of 105 degrees centigrade, they are also tumbler dried for 20 to 25 minutes to allow the spandex to restore its original elasticity and width (the elasticity and width of the spandex after hair brushing has been largely changed); enveloped by the face yarn 31 and bottom yarn 32, that temperatures for dyeing and shaping are all within the best ranges which are measured in real conditions, it can be seen without difficulty that the procedure of study and development of the present invention is hard.

Moreover, the above stated conventional duplex brushed fabrics are provided mostly with single transverse directional slight extensibility, if the spandex is added directly, a product elongated by the transverse directional extensibility will render itself to deform from a square shape before extension to a rectangular shape after extension, and is inconvenient for use nor is in good looking, it has been really studied hard to render the product to have equal rate of elongation both in transverse and longitudinal directions, in view of this, the ratio of material feeding of the yarn in the present invention is the major characteristic of the present invention.

The duplex brushed fabrics made by the present invention is provided with fine elasticity as well as extensibility, they can therefore be made with smaller size when they are used to produce gloves, hats or stockings etc., and when in practical wearing, they can be worn propitiously merely by shoring up with a human body, hence they are favorable to carrying and storing, yet they fit tight to the skin of the human body, thus have better effect of keeping warm.

i. the fabric being delivered to a stenter machine 43 for the second time shaping under the shaping temperature of about 160 degrees centigrade, and is shaped under the delivering speed of 10 to 15 yards/minute to shape it once more;

j. completing the finished product 44 which has extensibility in both longitudinal and transverse directions.

It can be seen from FIG. 3, the main difference of the manufacturing process of the duplex brushed fabric of the present invention from that of the conventional duplex brushed fabric, in addition to adding spandex and a second time shaping, the following is stressed: the time for adding hair raising oil is extremely important.

The inventor of the present invention found after the experiment taking about one year that, if the spandex is added directly while keeping the other procedures unchanged, the fabric will have its yarn broken after hair brushing process, the inventor paid patience to make innumberable times of improvements and tests, and then got aware that: by adding the hair raising oil after dyeing, the spandex will not have its yarn broken by a brushing machine.

By the fact that the products of the present invention is high temperature (about 140–160 degrees centigrade) resistive without damage to the elasticity of the spandex by virtue of, in addition to that the spandex is In conclusion, the manufacturing process of the elastic & extensile fabric provided with elasticity as well as extensibility longitudinally and transversely of the present invention is innovative in the elasticity and extensibility in longitudinal and transverse directions of the fabric and is never existed in the markets, such outstanding characteristic of technique resulted from the highly inventive procedure and the significant improveness provided thereby have been now presented in the effect of the present invention, this can be widly applied in the industry and human daily life.

Having thus described the technical structure of my invention with practicability and improveness, therefore, what I claim as new and desire to be secured by Letters Patent of the United States is:

1. A manufacturing process of an elastic & extensile fabric provided with elasticity as well as extensibility longitudinally and transversely, is comprised of:

a. taking polyester as the material of yarn for making face yarn and bottom yarn, said face yarn occupying about 60% of the total yarn material, said bottom yarn occupying about 30% of the total yarn material, and spandex being added for making covering yarn occupying about 10% of the total yarn material;

b. mixedly cross knitting said face yarn, bottom yarn and covering yarn by using a towel forward covering set of a circular knitter to form embryonic cloth;

c. said embryonic cloth being delivered to a stenter machine for shaping under the temperature of about 140 degrees centigrade, and being shaped under the delivering speed of 15 yards/minute for shaping;

d. proceeding dyeing process on the yarn, temperature for dyeing being about 125–130 degrees centigrade, time for it being about 25 minutes;

e. lowering the temperature to 85 degrees centigrade, glacial acetic acid being then added for neutralization, cleansing and dehydration;

f. adding hair raising oil into said fabric;

g. practising brushing and hair cutting after drying by baking;

h. delivering said fabric to a duplex heating style tumbler dryer, wherein, temperature of dry hot air being in 120 degrees centigrade, besides, another gas being water vapour of 105 degrees centigrade, they being tumbler dried for 20 to 25 minutes;

i. delivering said fabric to a stenter machine for the second time shaping under the shaping temperature of about 160 degrees centigrade, and being shaped under the delivering speed of 10 to 15 yards/minute to shape it once more;

by means of the above stated process, said fabric is characterized by providing with fine extensibility in longitudinal and transverse directions and having total length of about 1.8 to 2 times of the original lengths of said fabric.

* * * * *